United States Patent [19]

Wright

[11] Patent Number: 4,998,520

[45] Date of Patent: Mar. 12, 1991

[54] REDUNDANT RESET FOR ELECTRONIC THROTTLE CONTROL

[75] Inventor: Danny O. Wright, Newport News, Va.

[73] Assignee: Siemens Automotive L.P., Troy, Mich.

[21] Appl. No.: 522,340

[22] Filed: May 11, 1990

[51] Int. Cl.[5] ..... F02D 11/10; F02D 41/26

[52] U.S. Cl. ..... 123/399; 123/179 B; 123/179 G; 364/431.11

[58] Field of Search ..... 123/399, 396, 179 B, 123/179 G, 361; 364/431.11, 431.09, 431.1

[56] References Cited

U.S. PATENT DOCUMENTS

| | | | |
|---|---|---|---|
| 4,205,376 | 5/1980 | Yoshida | 364/431.11 |
| 4,282,574 | 8/1981 | Yoshida et al. | 364/431.1 |
| 4,397,281 | 8/1983 | Nakano et al. | 123/179 B |
| 4,546,736 | 10/1985 | Moriya et al. | 123/179 G |
| 4,788,661 | 11/1988 | Morita | 364/431.11 |
| 4,888,697 | 12/1989 | Hemminger et al. | 364/431.11 |

FOREIGN PATENT DOCUMENTS

| | | | |
|---|---|---|---|
| 55-146241 | 11/1980 | Japan | 123/179 B |

*Primary Examiner*—Andrew M. Dolinar

*Attorney, Agent, or Firm*—George L. Boller; Russel C. Wells

[57] ABSTRACT

Redundancy is imparted to the reset signal from a voltage regulator integrated circuit by connecting an RC timing circuit with the regulated voltage output and with the reset pulse output such that a reset pulse derived from the regulated output voltage is given in the event that the reset output of the integrated circuit fails to give a reset pulse. An over-/under-voltage detector monitors the regulated voltage output for also giving a reset signal in the event that the regulated output strays beyond allowable limits. The occurrence of a reset causes interruption of electric power to the throttle motor and of fuel to the engine.

7 Claims, 1 Drawing Sheet

REDUNDANT RESET FOR ELECTRONIC THROTTLE CONTROL

FIELD OF THE INVENTION

This invention relates to an electronic throttle control system of an automotive vehicle internal combustion engine.

BACKGROUND OF THE INVENTION

In an electronic throttle control system of an automotive vehicle internal combustion engine, the accelerator pedal is electromechanically, rather than mechanically, coupled with the throttle blade. An example is disclosed in commonly assigned U.S. Pat. No. 4,850,319.

The preferred electromechanical actuator is a unipolar stepper motor gearlessly coupled with the throttle shaft, with the motor controlled by an electronic controller in accordance with several inputs, one of which is from the accelerator pedal. The preferred controller is microprocessor-based, comprising a devoted microprocessor.

The electronic controller and the stepper motor operate from voltages which are appreciably less than that of the vehicle's electrical system, for example 5 VDC vs. 12 VDC. Accordingly, the incorporation of a suitable voltage regulator is conventional, and a standard integrated circuit device can be used for this purpose.

A conventional practice in a microprocessor-based system is to reset the microprocessor at power up by means of a reset pulse, and so it is also conventional for the standard voltage regulator integrated circuit to have a reset output which gives a suitable reset pulse to the microprocessor at power up. Failure to reset the microprocessor at power up can give rise to the exercise of improper control over the throttle blade.

SUMMARY OF THE INVENTION

The present invention relates to the incorporation of a novel redundant reset into an electronic throttle control. The redundant reset can provide a reset pulse in the event that the reset output of the voltage regulator integrated circuit fails to give its usual reset pulse at power up. This redundancy is achieved by the addition of only two passive circuit components; in the disclosed embodiment, only a resistor and a capacitor are required.

An enhancement comprising an over-/under-voltage detector provides for the generation of a reset signal in the event that the reduced output voltage of the voltage regulator integrated circuit strays beyond allowable limits.

A further aspect of the invention arises from the recognition that while it is being reset, the microprocessor is non-functional in the system. Under this circumstance, the invention proposes that electric power be cut off to the stepper motor whereby the throttle blade will be mechanically operated by redundant return springs to closed position and that the delivery of fuel to the engine be interrupted so that the combustion process is interrupted. These operations are conducted by applying the reset signal to respective portions of the electronic throttle control circuitry that control the stepper motor current and the fuel flow respectively.

Thus, one may perceive that the inventive principles are intended to improve the reliability of the electronic throttle control and to require the functionality of the microprocessor as a condition for both stepper motor operation and delivery of fuel to the engine.

Further features, advantages, and benefits of the invention will be seen in the ensuing description and claims which should be considered in conjunction with the accompanying drawing. The drawing discloses a presently preferred embodiment of the invention according to the best mode contemplated for practicing the inventive principles.

DESCRIPTION OF THE PREFERRED EMBODIMENT

Figure 1:
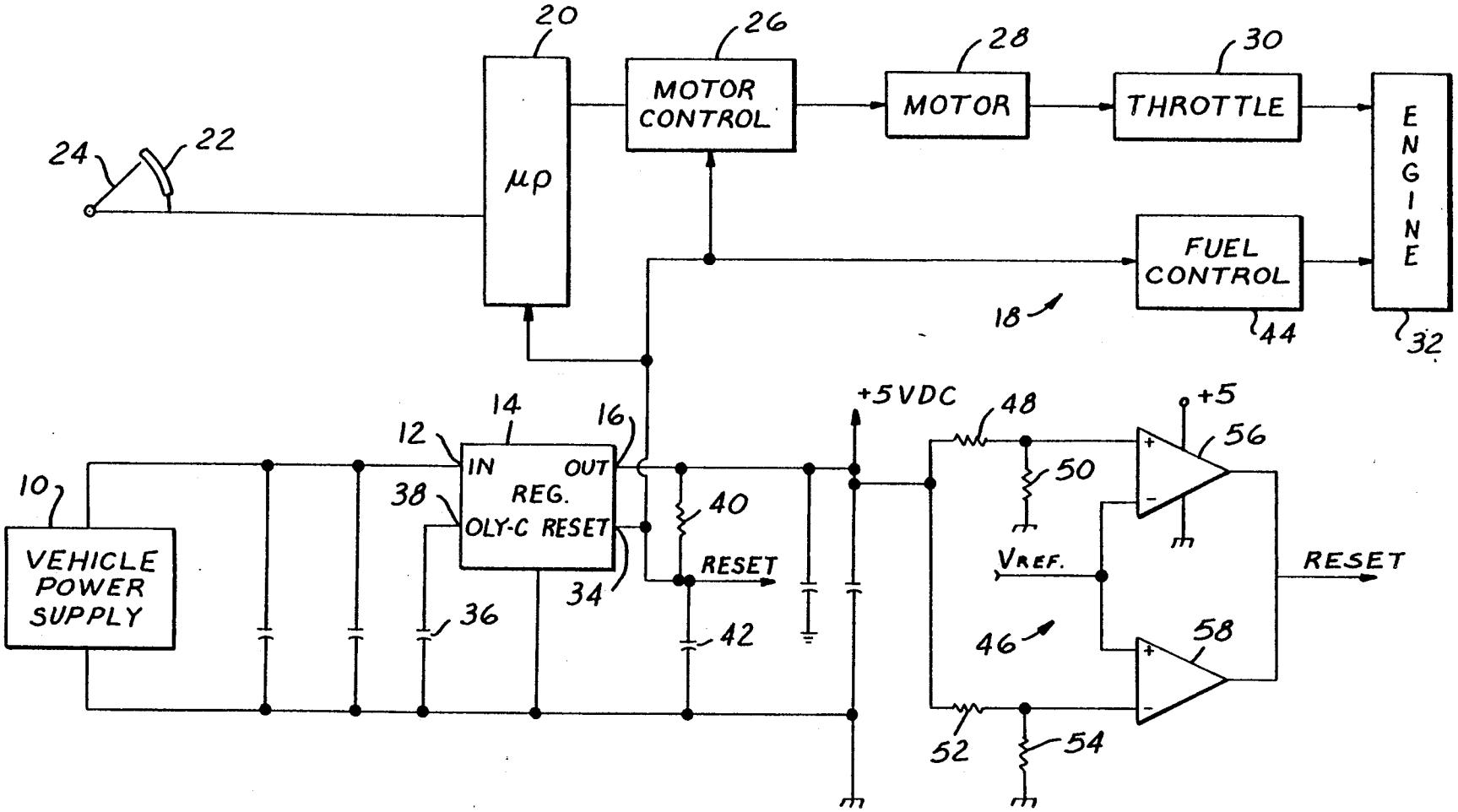
FIG. 1 is a schematic diagram illustrating an electronic throttle control system embodying the inventive principles.

The vehicle's power supply 10, for example 12 VDC nominal, forms the switched input voltage to the voltage input 12 of a voltage regulator integrated circuit 14, for example an SGS L487. The device 14 develops an appreciably lower regulated voltage, for example 5 VDC, at its voltage output 16. It is this lower voltage which powers the electronic throttle control system 18.

System 18 comprises a microprocessor 20 one of whose several inputs is from a transducer 22 operated by the vehicle's accelerator pedal 24. In turn, the microprocessor issues commands to a motor control circuit 26 which operates a motor 28 that positions the throttle 30 of the engine 32. Commonly assigned U.S. Pat. Nos. 4,850,319; 4,855,660; and 4,869,220 disclose details of an exemplary system.

Device 14 further comprises a reset output 34 at which a reset pulse is given each time that power supply 10 is switched to voltage input 12. The reset pulse is delivered to the reset input of microprocessor 20 to reset the microprocessor. The width of the reset pulse is established by the value of a capacitor 36 connected to a timing input 38 of device 14. In the illustrated embodiment, a reset signal is defined by the voltage at output 34 being pulled down below a certain level toward ground.

In accordance with certain principles of the invention, an RC timing circuit is associated with voltage output 16 and reset output 34. This circuit comprises a resistor 40 connected between 16 and 34, and a capacitor 42 connected between 34 and ground.

When device 14 issues a reset pulse at reset output 34, such a pulse is essentially rectangular in shape and for performing the intended reset function has a nominal width of 20–30 milliseconds. In the event that device 14 should fail to give such a reset pulse, a pulse signal suitable for resetting the microprocessor will nevertheless be given by virtue of the provision of the RC timing circuit. The energization of device 14 by power supply 10 will cause regulated voltage to appear at voltage output 16 with the result that the RC timing circuit is forced to execute an exponential transient to charge capacitor 42. Suitable selection of resistor 40 and capacitor 42 will endow the transient with a characteristic that is satisfactory for resetting the microprocessor. For example, 10K and 0.1 microfarad will yield satisfactory results. Thus, a certain redundancy has been imparted to the system with the inclusion of only two additional parts.

According to further principles of the invention, the occurrence of a reset signal at 34 also serves to shut off electrical power to motor 28 and to interrupt the flow of fuel to engine 32. To accomplish these objectives, the reset output 34 is coupled to motor control 26 and to a fuel control circuit 44. Because the application of a reset to motor control 26 removes all electrical power to motor 28, redundant return springs of throttle 30 are enabled to act to mechanically force the throttle blade toward closed position, if it is not presently there. The application of a reset to fuel control 44 closes the fuel flow.

For normal operation at engine start-up, the length of time for which the interruptions occurs is quite brief. If however there is at any time an abnormality which results in prolonged generation of a reset, the interruptions will continue.

Still further principles of the invention involve the incorporation of an over-/under-voltage detection circuit 46 that monitors voltage output 16. This circuit comprises four resistors 48, 50, 52, and 54, and two comparators 56 and 58 connected as illustrated. A reference voltage taken from elsewhere than voltage output 16 is supplied to the inverting input of comparator 56 and to the non-inverting input of comparator 58. Resistors 48 and 50 form a divider which delivers a fraction of the output voltage at 16 to the non-inverting input of comparator 56, and resistors 52 and 54 do the same for the inverting input of comparator 58. The comparators' outputs are connected to the reset line.

If the voltage at output 16 strays outside of a certain band around the nominal 5 VDC output, a reset signal is given by detection circuit 46. For example, such a band may comprise voltages that are up to one-quarter volt above or below nominal. In this way, an abnormal voltage at voltage output 16 will also create a reset.

Therefore, the inventive principles yield a beneficial redundancy in generating a reset in an electronic throttle control system. While a preferred embodiment of the invention has been illustrated and described, it should be appreciated that principles are applicable to other equivalent embodiments.

What is claimed is:

1. In an automotive vehicle electrical system having a D.C. power supply of given voltage for powering certain circuits of the electrical system with substantially that voltage, said electrical system comprising other circuits, including a microprocessor, operating at a voltage that is appreciably less than said given voltage, said microprocessor comprising a reset input via which the microprocessor can be reset by an externally delivered reset signal, said electrical system further comprising a voltage regulator integrated circuit that is powered by said given voltage to develop said lesser voltage therefrom, said voltage regulator integrated circuit comprising a voltage input receiving said given voltage, a voltage output delivering said lesser voltage, a reset pulse output at which a reset pulse is given each time that said voltage regulator integrated circuit is powered up by the application of said given voltage to said voltage input of said voltage regulator integrated circuit, and a timing input to which an external circuit is connected to set the width of each reset pulse issued by said voltage regulator integrated circuit at said reset pulse output thereof, and coupling means for coupling each reset pulse from said reset pulse output of said voltage regulator integrated circuit to said reset input of said microprocessor, the improvement which comprises external timing circuitry connected with said voltage output of said voltage regulator integrated circuit and with said reset input of said microprocessor such that a reset pulse derived from said lesser voltage given at said voltage output of said voltage regulator integrated circuit is delivered to said reset input of said microprocessor via said coupling means should said voltage regulator integrated circuit itself fail to give a reset pulse at its own reset pulse output upon said voltage regulator integrated circuit being powered up by the application of said given voltage to said voltage input of said voltage regulator integrated circuit.

2. The improvement set forth in claim 1 further including an over-/under-voltage detecting circuit having an input coupled to said voltage output of said voltage regulator integrated circuit, an output connected with said reset input of said microprocessor, and means for causing a reset signal to be given to said microprocessor's reset input whenever the output voltage appearinq at said voltage output of said voltage regulator integrated circuit is outside of a band containing said lesser voltage.

3. The improvement set forth in claim 2 in which said other circuits of said electrical system include one or more of: a fuel cutoff circuit for cutting off fuel to an engine powering a vehicle containing the electrical system whenever a reset is being given to said microprocessor reset input; and a throttle control circuit for controlling an electric-motor operated throttle mechanism for such an engine; and in which said coupling means also has a circuit connection to such one or more of said other circuits for causing, when a reset signal is given to said microprocessor's reset input, fuel to be cut off to the engine in the case of the fuel cutoff circuit, and the electric motor of the throttle mechanism to be electrically de-energized in the case of the throttle control circuit.

4. The improvement set forth in claim 1 in which said timing circuitry comprises an RC series circuit connected across said voltage output of said voltage regulator integrated circuit and the junction of the resistance and capacitance of said RC series circuit being connected to said reset output of said voltage regulator integrated circuit.

5. In an automotive vehicle having an engine equipped with an air/fuel intake system that includes a throttle operated by an electric motor, and an electronic throttle control circuit, including a microprocessor, for controlling the operation of said electric motor, said vehicle being also equipped with an electrical system having a D.C. power supply of given voltage for powering certain electrical circuits of the electrical system with substantially that voltage, said electrical system still further comprising a voltage regulator circuit that is powered by said given voltage to develop an appreciably lesser voltage therefrom, said electronic throttle control circuit and said electric motor operating at said lesser voltage, and said voltage regulator circuit comprising a voltage input receiving said given voltage, a voltage output delivering said lesser voltage, and a reset output at which a reset signal is given each time that said voltage regulator circuit is powered up by the application of said given voltage to said voltage input, said microprocessor comprising a reset input terminal, and including coupling means for coupling said reset signal from said reset output of said voltage regulator circuit to said reset input of said microprocessor, the improvement which comprises an external timing circuit connected with said voltage output of said voltage regulator circuit, with said microprocessor's reset input, and with a motor current supply stage of said electronic throttle control circuit such that a reset signal derived from voltage given at said voltage regulator's voltage output is delivered to said reset input of said microprocessor and to said electronic throttle control circuit should said voltage regulator circuit itself fail to give a reset signal at its reset output upon said voltage regulator circuit being powered up by the application of said given voltage to said voltage input of said voltage regulator circuit, and said motor current supply stage of said throttle control circuit comprising means to interrupt the delivery of electric current to said electric motor during application of a reset signal to said electronic throttle control circuit.

6. The improvement set forth in claim 5 further including an over/under-voltage detecting circuit having an input coupled to said voltage output of said voltage regulator circuit, an output connected with said microprocessor reset input and with said electronic throttle control circuit, and means for causing a reset signal to be given to said microprocessor reset input and to said electronic throttle control circuit whenever the output voltage appearing at said voltage output of said voltage regulator circuit is outside of a band containing said lesser voltage.

7. In an automotive vehicle having an engine equipped with an air/fuel intake system that includes a throttle operated by an electric motor, and an electronic throttle control circuit for controlling the operation of said electric motor, said vehicle being also equipped with an electrical system having a D.C. power supply of given voltage for powering certain electrical circuits of the electrical system with substantially that voltage, said electrical system still further comprising a voltage regulator circuit that is powered by said given voltage to develop an appreciably lesser voltage therefrom, at least one of said electronic throttle control circuit and said electric motor operating at said lesser voltage, and said voltage regulator circuit comprising a voltage input receiving said given voltage, a voltage output delivering said lesser voltage, and a reset output at which a reset signal is given each time that said voltage regulator circuit is powered up by the application of said given voltage to said voltage input, and including coupling means for coupling said reset signal from said reset output of said voltage regulator circuit to a reset input of said electronic throttle control circuit, the improvement which comprises an external timing circuit connected with said voltage output of said voltage regulator circuit and with said electronic throttle control circuit's reset input such that a reset signal derived from voltage given at said voltage regulator's voltage output is delivered to said reset input of said electronic throttle control circuit should said voltage regulator circuit itself fail to give a reset signal at its reset output upon said voltage regulator circuit being powered up by the application of said given voltage to said voltage input of said voltage regulator circuit, said electronic throttle control circuit comprising a motor current supply stage through which electric current is delivered to said electric motor and means to interrupt the delivery of electric current through said motor current supply stage to said electric motor during application of a reset signal to said electronic throttle control circuit, and said electronic throttle control circuit also comprising a fuel deliver control stage for controlling fuel flow to the engine and means to cause said fuel deliver control stage to interrupt the flow of fuel to the engine during application of a reset to said electronic throttle control circuit.

* * * * *